United States Patent [19]

Panetti

[11] Patent Number: 4,548,070

[45] Date of Patent: Oct. 22, 1985

[54] APPARATUS FOR MEASURING UNDULATORY DEFORMATIONS OF THE ROLLING SURFACE OF RAILROAD RAILS

[75] Inventor: Romolo Panetti, Geneva, Switzerland

[73] Assignee: Speno International S.A., Geneva, Switzerland

[21] Appl. No.: 540,688

[22] Filed: Oct. 11, 1983

[30] Foreign Application Priority Data

Oct. 18, 1982 [CH] Switzerland ..... 6044/82

[51] Int. Cl.[4] ..... G01B 7/28

[52] U.S. Cl. ..... 73/105; 33/1 Q; 33/552; 33/523; 73/146

[58] Field of Search ..... 73/146, 105; 33/1 Q, 33/174 P, 174 PA, 174 L

[56] References Cited

U.S. PATENT DOCUMENTS

| | | | |
|---|---|---|---|
| 4,075,888 | 2/1978 | Buhler | 73/146 |
| 4,288,855 | 9/1981 | Panetti | 73/146 |
| 4,391,134 | 7/1983 | Theurer | 73/146 |
| 4,417,466 | 11/1983 | Panetti | 73/146 |

FOREIGN PATENT DOCUMENTS

| | | |
|---|---|---|
| 814601 | 8/1951 | Fed. Rep. of Germany . |
| 823456 | 10/1951 | Fed. Rep. of Germany . |
| 869608 | 1/1953 | Fed. Rep. of Germany . |
| 1185639 | 9/1965 | Fed. Rep. of Germany . |
| 2112533 | 1/1972 | Fed. Rep. of Germany . |
| 316615 | 7/1974 | Fed. Rep. of Germany . |
| 2410564 | 9/1975 | Fed. Rep. of Germany . |
| 1496675 | 8/1967 | France . |
| 2053294 | 4/1971 | France . |
| 2485183 | 12/1981 | France . |
| 46-2306 | 1/1971 | Japan . |
| 500335 | 1/1971 | Switzerland . |
| 630015 | 5/1982 | Switzerland . |
| 800766 | 9/1958 | United Kingdom . |

*Primary Examiner*—Donald O. Woodiel
*Attorney, Agent, or Firm*—Young & Thompson

[57] ABSTRACT

It comprises a chassis (1) resting on at least one rail (3) by means of contact members (4, 4') connected to a vehicle (V) traversing the track. It comprises at least a detector (2) delivering an electric signal representing the distances separating a rectilinear reference space defined by the position in space of said chassis (1) and successive points on the surface of the rail line (3) traversed. The contact members of the chassis (1) with the rail (3) are constituted by two shoes (4, 4') articulated on the chassis (1) about axes (5) perpendicular to the longitudinal axis of the rail. The extent of these shoes (4, 4') in the longitudinal direction of the rail (3) is at least equal to twice the wavelength (l) of the undulatory deformations of the rail of short wavelength, but less than the wavelength (L) of the undulatory deformations of long wavelength.

11 Claims, 8 Drawing Figures

APPARATUS FOR MEASURING UNDULATORY DEFORMATIONS OF THE ROLLING SURFACE OF RAILROAD RAILS

The present invention has for its object an apparatus for measuring the undulatory deformations of the rolling surface of railroad rails.

The geometrical characteristics of this type of deformation, wavelength and amplitude, are not regular and depend on the mechanical characteristics of the trains, their speed of travel, the local elasticity of the track, and the magnitude of the resonance phenomena which are produced by their passage.

These deformations are classified essentially according to their causes and effects in different ranges of wavelength (short waves from 3 to 30 cm, and long waves from 30 cm to 3 m).

These deformations worsen with time and progressively cause increasingly important damage to the rolling stock and to the tracks, and decrease the comfort of passengers and those in the vicinity by the vibrations and sound waves which they generate.

Before the damage attains critical proportions, operations for rectifying the rolling surface of the rails are conducted in the form of periodic maintenance of the track and are effected with the aid of rail vehicles provided with grinders, abrasive blocks or smoothers moved along the generatrices of this surface until the above deformations are eliminated.

To decide the opportune moment to practice these operations, it is necessary periodically to check the amplitude of these undulatory deformations not only in the range of short wavelengths but also in the range of long wavelengths and this check must be repeated during and after the rectification operations to determine the progress of the rectification operation and to avoid unnecessary passes.

This check is effected by means of appropriate measuring devices provided on a separate measuring vehicle or the rectification vehicle itself.

The known measuring devices comprise one or several distance detectors, mechanical or electronic or other, on a chassis which serves as a reference base and bears on the rolling surface of the rail, either through rollers, or through one or two shoes rigidly secured to this chassis. Such measuring devices are described for example in Swiss Pat. No. 630,015 or French Pat. No. 2,485,183.

These known devices are schematically illustrated in FIGS. 1 and 2 of the drawing.

The rail surface has deformations of long wavelength on which are superposed deformations of short wavelength. The output signal delivered by the distance detector d carried by the reference base r is a function not only of the short or long undulatory deformations of the rail, but also of the base position of the reference r relative to the rail which is modified, in the course of moving the chassis along the rail, by the undulatory deformations of the rail. Thus, the chassis follows, by its rollers or shoes, the peaks and the valleys of the undulatory deformations thus modifying the position of the reference base, and therefore its distance relative to the rail such that the measurement effectuated by the detector d is thereby affected.

In certain measuring devices it has been proposed to use an extremely complicated electronic apparatus making use of the mean effective wavelength as well as a complex transfer coefficient which can be determined only approximately so as to attempt to render the measurement of the undulatory deformations of the rail independent of the movements of the reference base engendered by these rail undulations. Despite that, the precision of the measurement is not actually satisfactory, given the even greater requirements imposed for the quality of the rolling table of the rail. Moreover, these devices comprise complex electronics requiring frequent maintenance and in any event the measurement is but approximate because its precision depends essentially on that of the transfer coefficient.

The aim of the present invention is to provide a measurement apparatus for the undulatory deformations of the rolling surface of railroad rails which will be of simple construction, easy to adjust and maintain, and the position of whose base reference will not be influenced by undulatory deformations of short wavelength, and which will permit the determination of the undulatory wear of long wavelength, as well as of short wavelength.

The accompanying drawings show schematically and by way of example two embodiments of the measuring apparatus according to the invention.

FIGS. 1 and 2, as mentioned above, are schematic illustrations of known devices.

Figure 1:
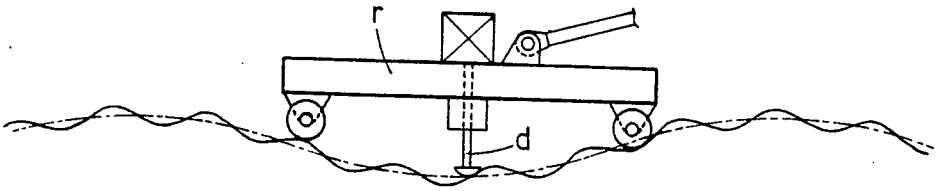
FIG. 1 (PRIOR ART)
Figure 2:
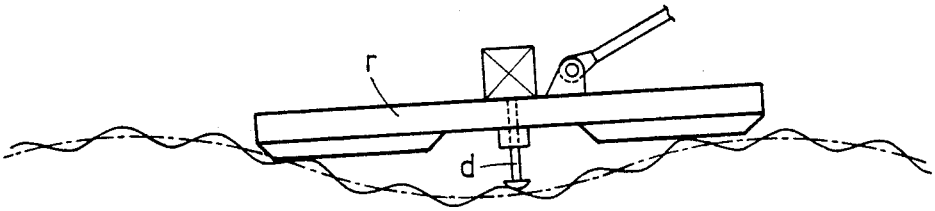
FIG. 2 (PRIOR ART)
Figure 3:
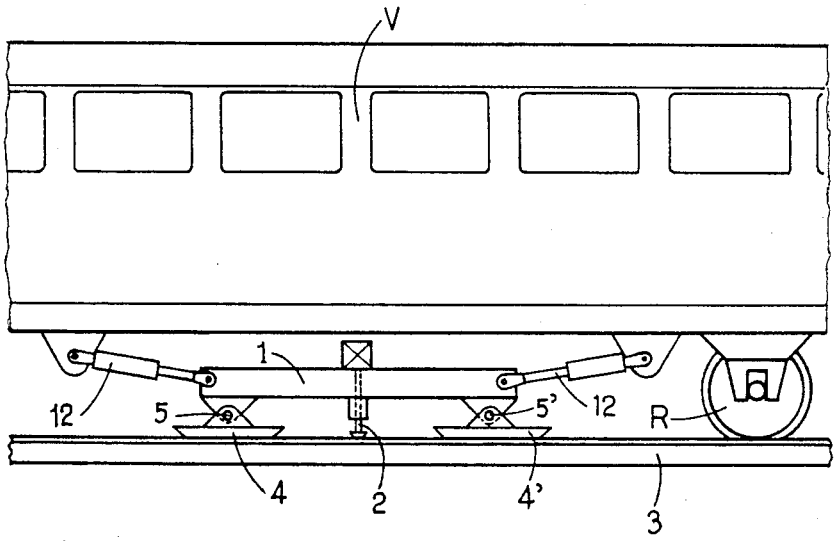
FIG. 3 shows a first embodiment of the measuring apparatus resting on a rail and connected to a railway vehicle.
Figure 4:
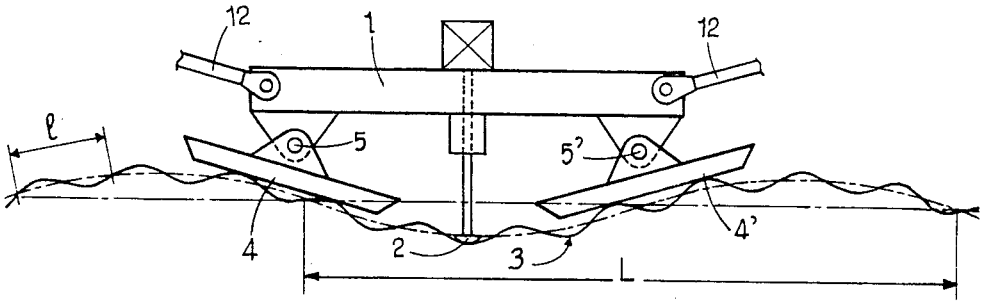
FIGS. 4 and 5 show the measuring apparatus of FIG. 3 respectively in a valley and on a crest of an undulatory deformation of long wavelength of the rail.
Figure 5:
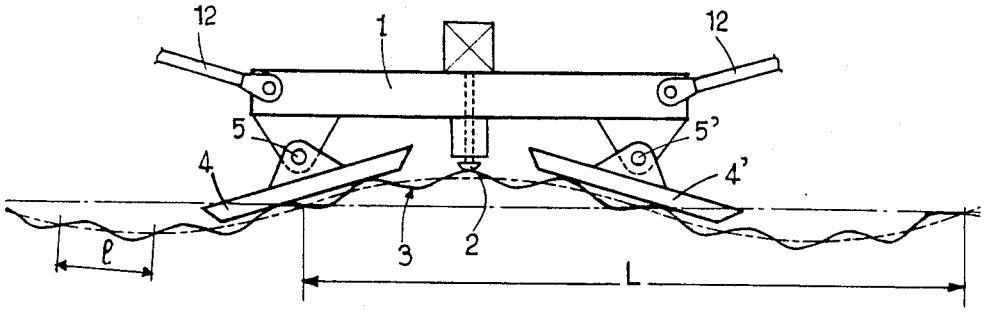
Figure 6:
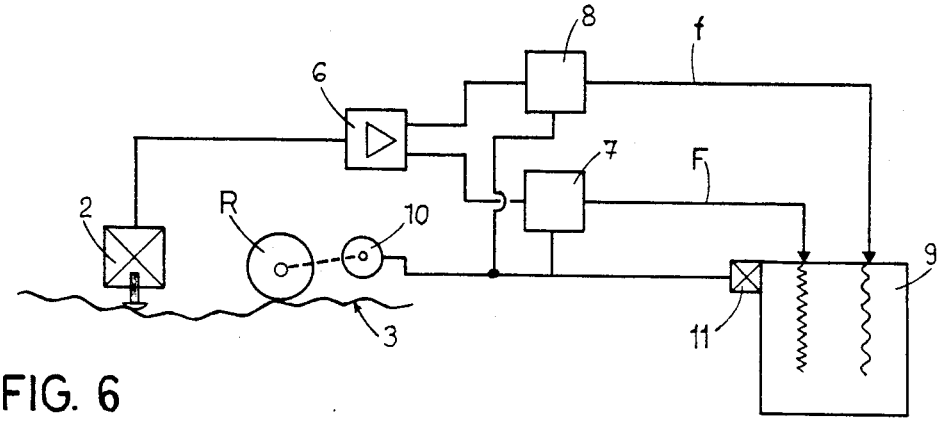
FIG. 6 shows schematically the handling of the signal delivered by the distance detector of the measuring device of FIGS. 3 to 5.

The measuring device of the undulatory deformations of a rail shown in FIGS. 3 to 6 comprises a chassis 1 carrying at least one distance detector 2, mechanical, electronic or other, delivering a signal representing the distance separating the reference base, constituted by the position in space of chassis 1, from a point on the surface of rail 3.

As shown, the surface of this rail comprises undulatory deformations of short wavelength l superposed on undulatory deformations of long wavelength L.

This chassis 1 of the measuring device bears on the surface of rail 3 by means of two shoes 4, 4' articulated on the chassis about axes 5, 5' normal to the longitudinal axis of the rail. These axes are preferably substantially parallel to the rolling surface of the rail.

The extension of each shoe 4, 4' in the longitudinal direction of the rail is at least equal to twice the wavelength l of the short undulatory deformations which it is desired to measure with precision. Therefore, each shoe 4, 4' always rests on at least two successive peaks of these short undulatory deformations and each shoe 4, 4' is inclined so as to be positioned substantially on a tangent to the long wavelength rail undulation opposite its axis of articulation 5, 5'.

In this way, the position of the reference base for measuring, determined by the position in space of the chassis 1, is independent of the undulatory deformations of short wavelength l and no longer depends on the undulatory deformations of long wavelength L.

Preferably and for constructional reasons, the interaxial distance between the articulations of the two shoes is at least equal to twice the wavelength of the waves of short wavelength which it is desired to measure with precision, which is to say the length of an oscillatory shoe 4, 4', but at most equal to the wavelength of the longest undulatory deformations.

Thanks to this construction, the signal delivered by the distance detector 2 is a signal representative of the amplitude of the long undulatory deformations modulated by the amplitude of the short undulatory deformations. It is thus a simple measurement signal comprising a low frequency component corresponding to the long undulatory deformations independent of the short undulatory deformations and the high frequency component corresponding to the short undulatory deformations independent of the long undulatory deformations.

The treatment of this measurement signal is thus quite simple, it suffices to amplify it at 6, then to separate its high and low frequency components by means of on the one hand a high pass filter 7 and on the other hand a low pass filter 8 to obtain signals f and F representative to the undulatory deformations of short wavelength and of long wavelength, respectively.

These signals f and F feed two inputs of a recorder whose tape 9 unwinds at a speed proportional to the speed of the measurement vehicle. This is achieved in known fashion by an impulse generator 10 driven by a wheel R of the tractor vehicle feeding a stepping motor 11 driving the paper tape of the recorder.

Thanks to this construction, there is no longer an influence of the short undulatory deformations on the measurement of the long undulatory deformations and vice versa, whereby the measurement of these two types of undulatory deformations is very precise and the electrical treatment of the measurement signal is simplified.

Figure 7:
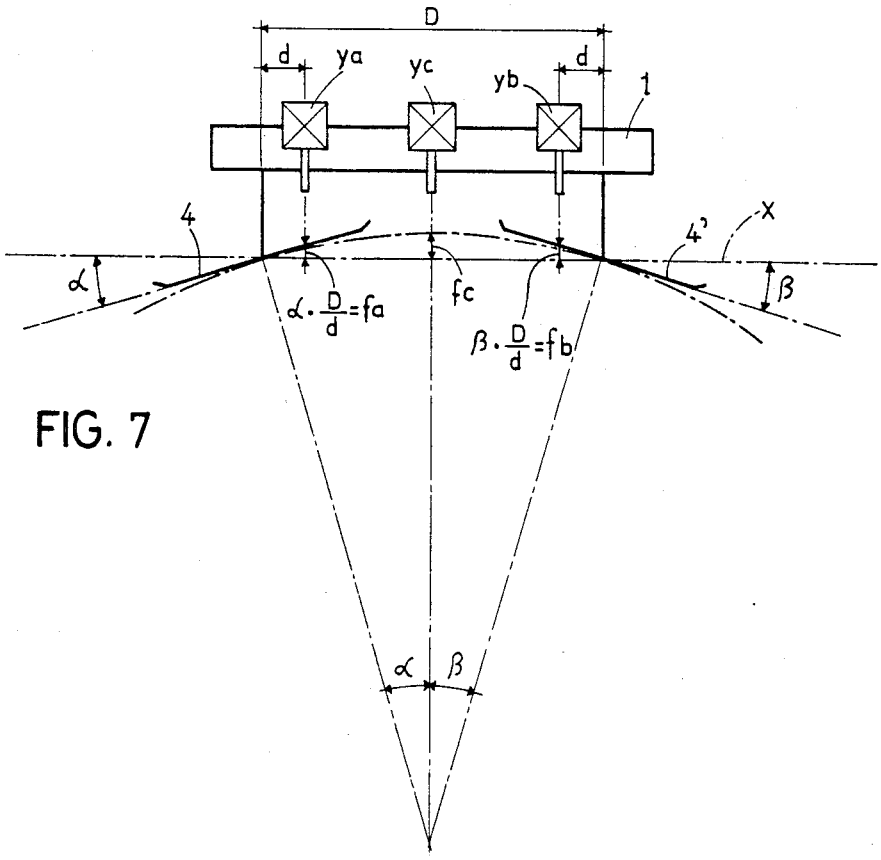
FIG. 7 shows schematically a second embodiment of the measuring apparatus.

The second embodiment of the measuring device shown in FIG. 7 also comprises a chassis 1 provided, as in the first embodiment, with shoes 4, 4' articulated on axes. The interaxial distance between the pivotal axes of the shoes 4, 4' and the length of these shoes are determined in the same way as in the first embodiment.

The chassis 1 carries three distance detectors ya, yb and yc of which yc is located midway between the other two, and midway of the interaxial distance separating the pivots of the shoes 4, 4'.

The distance detector yc measures the distance separating a point on the surface of the rail from the reference base, while the distance detectors ya and yb measure the distances separating a point on the upper face of each shoe 4, 4' from said reference base. These distances are in fact representative of the inclination $\alpha$, $\beta$ of the shoes 4, 4' relative to the imaginary line which should be the rail surface.

If, as is in fact the case for railroad rails, fc is very small and the radius of curvature of the long waves of the rails is relatively great, the arc of a long undulation of the rail may be comparable to a parabola.

Under these conditions $fc=D^2/8R$

The articulated shoes 4, 4' orient themselves automatically tangentially to the deformation of long wavelength and form angles $\alpha$ and $\beta$, respectively, with a straight line parallel to the reference base, passing through the contact points of the shoes with the rail.

These angles are small whereby the distances separating the straight line X of the shoe 4, 4' measured opposite the distance detector ya, yb are given by $\alpha$.d and $\beta$.d, respectively, these angles being expressed as radiants.

Moreover under these particular conditions $\alpha+\beta \simeq D/R$ from which $$fc=D/R\cdot D/d=(\alpha+\beta)\cdot D/d=\alpha\cdot D/d+\beta\cdot D/d$$

If the construction is so effected that the projection d, on the reference base, of the difference separating the distance detectors ya and yb from the pivot of the corresponding shoe 4, 4' will be equal to D/8 then it follows that:

$$fa=\alpha\cdot D/8$$

$$fb=\beta\cdot D/8$$

$$fc=(\alpha+\beta)\cdot D/8=fa+fb$$

It will be seen in this embodiment that the arrow fc which represents the long wave is given by the sum of the measurements of fa and fb.

In practice, the short waves are superposed on the long waves whereby the central detector yc, measures a magnitude which corresponds to the sum of the deformations due to the short and long waves while the sum of the measurements of the detectors ya and yb corresponds to the amplitude of the long wave deformations.

Thus, to have the amplitudes of the short waves it suffices to provide by suitable electronic means $$fc-(fa+fb)$$

It is evident that the distance detectors ya and yb can be replaced by detectors of the angular position of the shoes 4, 4'.

Finally, it must be noted that when the axis of the rail to be measured is concave, the shoes by virtue of their length subtend small sagittae. But this is not troublesome because they can be compensated by a correction factor.

Thus, by use of three distance detectors suitably positioned the amplitudes of the long and short waves may be determined by means of an extremely simple treatment of the signals delivered by the detectors.

This measuring device is very sensitive and can even be used for levelling operations or to control the level of the track.

The chassis 1 is connected to a railway vehicle V by two hydraulic jacks 12 permitting its lifting and its guidance along the rail line.

The railway vehicle V may be provided with at least a measuring device by rail line. The shoes 4, 4' may comprise in known manner vertical flanks or rollers adapted to come into contact with the internal flank of the rail head under the action of spacer means to ensure the lateral guidance of the chassis 1 on the rail 3.

Figure 8:
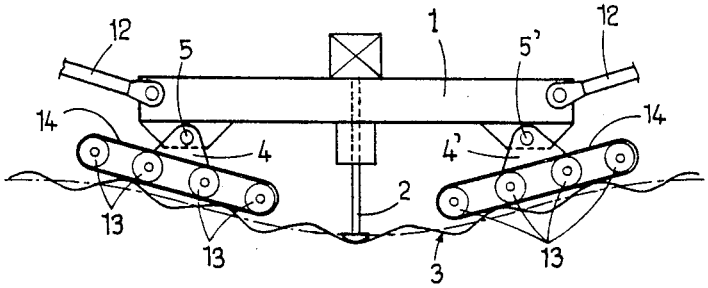
FIG. 8 shows a modification of the oscillatory shoes of the measuring device.

In the modification shown in FIG. 8, the chassis 1 is also provided with articulated shoes 4, 4' and with a distance detector 2. To limit wear of the shoes 4, 4' due to rubbing of the latter on the surface of the rail, these shoes are provided with wheels or rollers 13 serving as guide and support for a band or chain 14. Thus, during their displacement along the rail, the shoes oscillate and roll, the band 14 circulating about the rollers 13, which reduces greatly the wear of the shoes. In an unillustrated modification, the rollers 13 and the chains or bands 14 may be replaced by a succession of rollers of small diameter very close to each other.

The chassis 1 may comprise several distance detectors offset transversely relative to the rail to measure the undulatory deformations of several different generatrices of the rail head.

Such a measurement device is thus of small size, is rugged, simple and precise and requires practically no maintenance.

I claim:

1. Apparatus for measuring undulatory deformations of the rolling surface of rails of a railway comprising a chassis, resting on at least one rail by means of contact members, adapted to be connected to a vehicle traversing the track and comprising at least a detector delivering an electrical signal representing the distances separating a rectilinear reference base defined by the position in space of said chassis and successive points on the surface of the rail line traversed, characterized by the fact that the contact members of the chassis with the rail are constituted by two shoes articulated on the chassis about axes perpendicular to the longitudinal axis of the rail; by the fact that the extent of these shoes in the longitudinal direction of the rail is at least equal to twice the wavelength of the undulatory deformations of the rail of short wavelength, but less than the wavelength of the undulatory deformations of long wavelength.

2. Apparatus according to claim 1, characterized by the fact that the distance separating the pivotal axes of the two shoes of the chassis is greater than twice the wavelength of the short undulatory deformations, but less than the wavelength of the undulatory deformations of long wavelength.

3. Apparatus according to claim 1, characterized by the fact that the shoes comprise a vertical portion adapted to bear on the internal flank of the rail under the action of a spacer means.

4. Apparatus according to claim 1, characterized by the fact that each shoe comprises pivotal rollers about which circulates a band or chain.

5. Apparatus according to claim 1, characterized by the fact that it is connected to the railway vehicle by means of jacks permitting its raising.

6. Apparatus according to claim 1, characterized by the fact that it comprises several distance detectors offset transversely relative to the rail measuring the undulatory deformations of several different generatrices of the rail head.

7. Apparatus according to claim 1, characterized by the fact that each measurement detector delivers a signal corresponding to the amplitude of the undulatory deformations of long wavelength, modulated by the amplitude of the undulatory deformations of short wavelength, and that it comprises an electronic means for treating this signal.

8. Apparatus according to claim 7, characterized by the fact that it comprises a low pass filter which passes the low frequency component of the signal, corresponding to the undulations of long wavelength, and a high pass filter, in parallel with the low pass filter, which passes the high frequency component corresponding to the undulations of short wavelength.

9. Apparatus according to claim 1, characterized by the fact that it comprises three longitudinally offset distance detectors, the central detector delivering a signal proportional to the sum of the amplitudes of the deformations of long and short wavelengths.

10. Apparatus according to claim 9, characterized by the fact that the distance separating each of the other detectors from one of the axes of articulation of the corresponding shoe, projected on the reference base is equal to $\frac{1}{8}$ of the interaxial distance of the articulations of the shoes and by the fact that the sum of the signals delivered by these two detectors is proportional to the amplitude of only the undulations of long wavelengths.

11. Apparatus according to claim 10, characterized by the fact that it comprises an electronic means for treating the obtained signals delivering a signal proportional to the difference between the signal of the central detector and the sum of the signals of the other detectors, this signal corresponding to the amplitude of the undulations of short wavelength.

* * * * *